United States Patent [19]

Morse

[11] Patent Number: 5,076,071

[45] Date of Patent: Dec. 31, 1991

[54] SUCTION ACCUMULATOR WITH DIRT TRAP AND FILTER

[75] Inventor: Robert L. Morse, Adrian, Mich.

[73] Assignee: Tecumseh Products Company, Tecumseh, Mich.

[21] Appl. No.: 520,536

[22] Filed: May 8, 1990

[51] Int. Cl.[5] ..... F25B 43/00

[52] U.S. Cl. ..... 62/503; 55/192

[58] Field of Search ..... 62/503, 474, 470, 475; 55/192

[56] References Cited

U.S. PATENT DOCUMENTS

| | | | |
|---|---|---|---|
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,331,001 | 5/1982 | Jones | 62/503 |
| 4,354,362 | 10/1982 | Schumacher et al. | 62/474 |
| 4,474,034 | 10/1984 | Avery, Jr. | 62/503 |
| 4,509,340 | 4/1985 | Mullally et al. | 62/503 |
| 4,827,725 | 5/1989 | Morse | 62/503 |

*Primary Examiner*—Henry A. Bennett

*Attorney, Agent, or Firm*—Baker & Daniels

[57] ABSTRACT

A suction accumulator for the compressor of a refrigeration system including a disk-shaped dirt trap baffle member spaced from the wall of the vessel to form a gap through which liquid refrigerant flows from an active zone above the baffle to a quiet zone therebelow. Within the quiet zone, liquid refrigerant flows from a radially outer region to a radially inner region along a tortuous flow path. A bleed-through orifice in a gaseous refrigerant flow conduit siphons liquid refrigerant from the radially inner region into the gaseous flow path. Foreign particles suspended in the liquid refrigerant are isolated within the accumulator at various points along the flow path, particularly within the quiet zone. A cup-shaped porous filter is disposed over the lower end of the conduit for the gaseous refrigerant to filter liquid refrigerant before it flows through the orifice.

19 Claims, 2 Drawing Sheets

SUCTION ACCUMULATOR WITH DIRT TRAP AND FILTER

BACKGROUND OF THE INVENTION

The present invention relates to a suction accumulator which separates the liquid components of the refrigerant from the gaseous components thereof and provides a storage or sump for the liquid refrigerant.

Most compressors adapted for use in refrigeration systems are designed for the compression of gaseous refrigerant. However, under some circumstances liquid refrigerant may flow from the evaporator into the suction inlet of the compressor. This condition, often referred to as slugging, may occur at start-up of the refrigeration system or during certain operating conditions of the system wherein the evaporator is flooded and excess liquid refrigerant enters the suction line returning to the compressor. If an accumulator is not provided, large quantities of condensed refrigerant return through the suction line to the crankcase of the compressor. When the compressor is restarted, the large quantity of liquid refrigerant present therein results in abnormally high pressures which frequently cause blown gaskets, broken valves, etc.

Suction accumulators, which are well known in the art, have been incorporated into refrigeration systems to act as storage reservoirs for liquid refrigerant which may be present in the suction line to prevent such liquid refrigerant from entering the compressor. Such accumulators permit the liquid refrigerant to change to its gaseous state before entering the compressor. A common type of accumulator comprises a vessel having a generally U-shaped tube received therein, one end of which is connected to the storage vessel and the other end of which is open to the interior of the vessel. As the incoming refrigerant flows into the vessel, the liquid component collects in the bottom thereof while the gaseous component is carried off through the U-tube and the outlet of the vessel to the compressor suction inlet. A bleed-through orifice in the wall of the U-tube, located in the lower portion of the vessel, meters a small quantity of liquid refrigerant into the stream of gaseous refrigerant flowing through the tube so that a larger slug of refrigerant is not introduced into the inlet of the compressor on start-up or during operation thereof.

A problem associated with a refrigeration system of the type to which the present invention pertains, includes the presence of dirt particles, and the like, suspended in the refrigerant and entrained, lubricating oil. When carried through the refrigeration system with the refrigerant, such dirt particles can cause premature mechanical wear or failure of system components, or impede the flow of refrigerant through the system, thereby causing system operating inefficiencies.

Various methods have been proposed for filtering dirt particles suspended in the refrigerant and lubricating oil of a refrigeration system, several of which are associated with the suction accumulator of the refrigeration system. For instance, it is known to provide a screen filter at the entry of the suction accumulator, whereby a screen essentially partitions the storage vessel between an entry chamber and a storage chamber. One problem with such an arrangement is that the filter screen is disposed within the refrigerant flow path, thereby causing an undesirable pressure drop in the refrigeration system. Furthermore, accumulation of the dirt particles on the filter screen could eventually cause clogging of the screen and a further pressure drop in the system.

Another approach to filtering dirt particles from a refrigeration system, involving the suction accumulator, is the provision of a filter at the location of the bleed through orifice located in the lower portion of the accumulator storage vessel. In such an accumulator, dirt particles are carried with the refrigerant into the vessel and are prevented from entering the bleed through orifice by means of a filter. However, swirling, turbulent environment within the storage vessel can result in the dirt particles reentering the refrigeration system through the open end of the U-tube. Furthermore, the provided filter can become clogged, thereby interfering with the desired metering of the liquid refrigerant into the gaseous refrigerant flow path.

While prior art attempts to filter dirt particles from the refrigerant in a refrigeration system have been somewhat successful, it is desired to provide an improved suction accumulator that is capable of trapping and isolating dirt particles, and preventing their reintroduction into the refrigeration system.

SUMMARY OF THE INVENTION

The present invention is an improvement over the suction accumulator disclosed in U.S. Pat. No. 4,827,725 in the name of Robert L. Morse and assigned to the assignee of the present application. This patent is expressly incorporated herein by reference. The suction accumulator disclosed in Patent No. 4,827,725 comprises a dirt trap baffle member which causes foreign particles suspended in the refrigerant to be separated and isolated in the accumulator, thereby preventing the particles from being drawn into the refrigeration system and causing potential damage to the compressor or clogging of the lines of the refrigeration system. Liquid refrigerant entering the accumulator is directed to a radially outer region in the bottom portion of the accumulator and then flows radially inwardly along a tortuous path before being metered into the gaseous refrigerant flowing through the U-shaped passageway at the center of the accumulator.

The accumulator is separated between an upper active zone and a lower quiet zone and liquid refrigerant is introduced into the lower quiet zone before being metered into the flow of gaseous refrigerant. Foreign particles suspended in the liquid refrigerant are separated from the refrigerant and isolated within the quiet zone, which zone has two regions successively interconnected along a tortuous path, whereby foreign particles can be isolated in both regions. Furthermore, a filter screen may be positioned within the liquid refrigerant flow path prior to the metering aperture.

In the accumulator described above, tests have demonstrated that the heavier dirt particles will settle out in an area that has little flow or disturbance, namely, the quiet zone within the lower portion of the accumulator. However, smaller dirt particles will remain in the liquid and can flow through the metering orifice to be entrained in the flow of gaseous refrigerant through the U-shaped flow passage within the center conduit. The larger the metering orifice, the greater the flow of liquid refrigerant, which results in larger particles of foreign matter being returned to the compressor.

In accordance with the invention of the present application in one form thereof, the suction accumulator includes a quiet zone for the very large particles to settle, which zone is defined by separating the turbulent liquid in the storage portion of the accumulator from the lower portion of the vessel by means of a baffle spaced inwardly from the sidewall of the accumulator to form openings or gaps at the radially outer periphery of the baffle and quiet zone. A porous, preferably cup-shaped filter is disposed within the quiet zone between the radially outer and inner areas of the quiet zone to isolate smaller dirt particles from the liquid flowing through the metering orifice. The porosity of the filter will dictate the size of particles which are filtered out of the liquid refrigerant. By providing a vent in the baffle, gas bubbles are permitted to vent back to the storage area of the accumulator, thereby increasing the effective usable area of the filter because cavitation of the gaseous refrigerant around the filter is prevented. The vent opening or openings are located below the upper edge of the filter, which is preferably in contact with the baffle, to thereby form a gas pocket which eliminates the need to gasket the upper end of the filter to the baffle since liquid refrigerant cannot flow through the gas pocket.

One advantage of the suction accumulator of the present invention is that larger foreign particles suspended in the refrigerant fluid of a refrigeration system may be isolated within a quiet zone of the suction accumulator, thereby preventing reentry of the particles into the refrigeration system and possible damage caused thereby. The smaller foreign particles that are able to flow through the quiet zone will then be separated out by the filter.

A further advantage of the suction accumulator of the present invention is that the accumulation, over time, of foreign particles in the suction accumulator will not degrade refrigeration system performance or prevent the suction accumulator from continuing to isolate further foreign particles.

A still further advantage of the suction accumulator of the present invention is that foreign particles of different sizes are capable of being isolated at different points along the flow path of the liquid refrigerant, as the refrigerant flows from within the storage vessel to the metering opening of the conduit.

The present invention, in one form thereof, comprises a suction accumulator including a vertical storage vessel defining an interior storage volume. The vessel has a top end and a bottom end and includes a vessel inlet and a vessel outlet located at the top end. The vessel is adapted for storing gaseous and liquid refrigerant introduced through the vessel inlet for drawing out through the vessel outlet. A conduit is disposed within the vessel and has one end connected to the vessel outlet. The conduit includes a gas inlet opening located toward the vessel top end for communication with the gaseous refrigerant. The conduit also has a liquid metering inlet located in a radially inner region of the interior storage volume toward the vessel bottom end for communication with the liquid refrigerant. The suction accumulator also includes a baffle disposed within the vessel for directing the liquid refrigerant within the vessel to a radially outer region of the interior storage volume located toward the vessel bottom end. An upwardly extending barrier is disposed between the radially outer region and the radially inner region, and causes tortuous flow of the liquid refrigerant from the radially outer region to the radially inner region. The baffle may comprise a radially extending partition for substantially separating the storage volume into an upper active zone and a lower quiet zone and a fluid passage for providing fluid communication between the active and quiet zones. A cup-shaped filter is disposed in the quiet zone between radially outer and radially inner regions thereof to filter liquid refrigerant flowing from the quiet zone to the metering inlet, the filter having a porous bottom wall and at least one porous side wall.

BRIEF DESCRIPTION OF THE DRAWINGS

The above mentioned and other features and objects of this invention, and the manner of attaining them, will become more apparent and the invention itself will be better understood by reference to the following description taken in conjunction with the accompanying drawings, wherein.

DESCRIPTION OF THE PREFERRED EMBODIMENT

Figure 1:
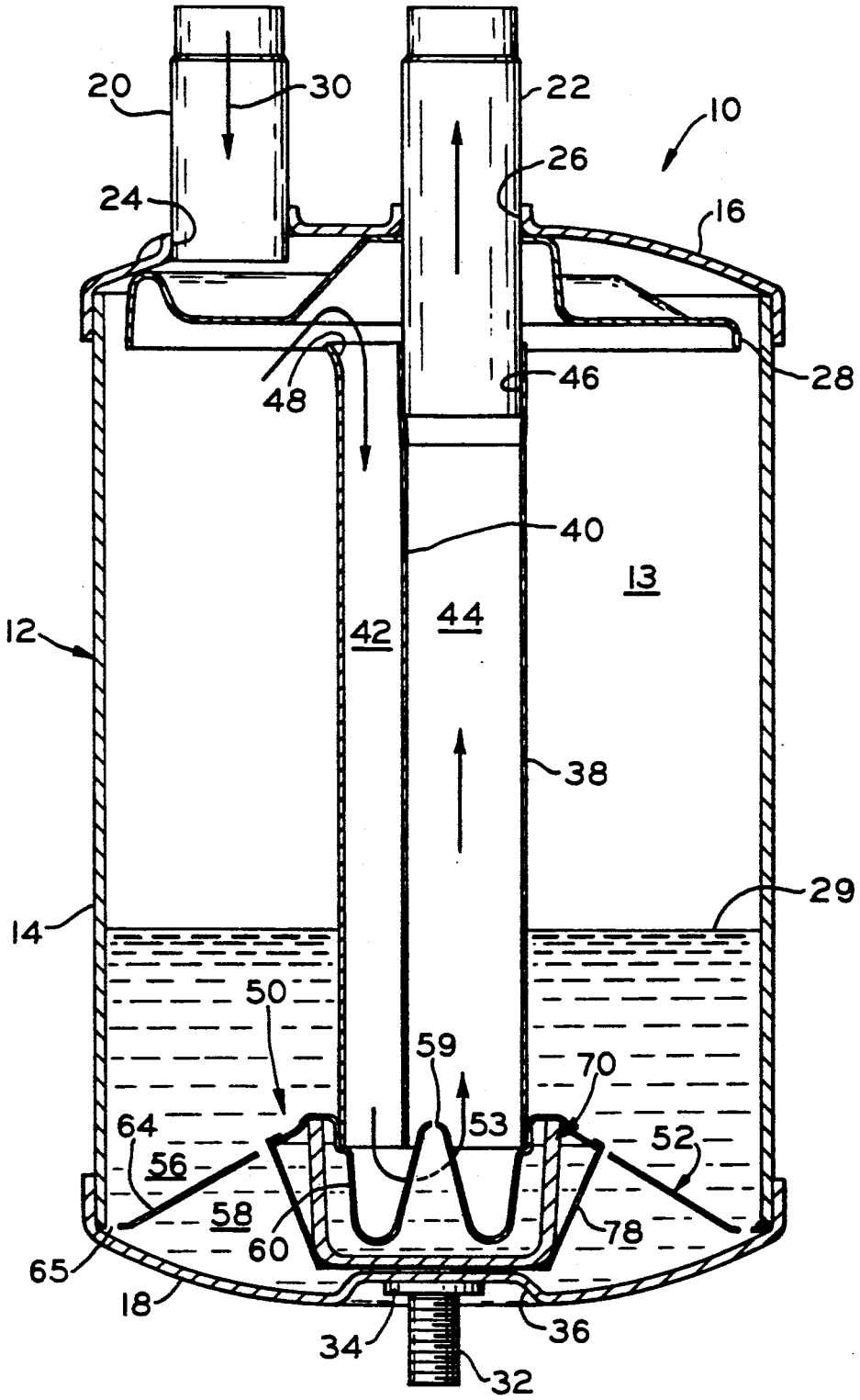
FIG. 1 is a longitudinal sectional view of a suction accumulator in accordance with the present invention.

Suction accumulator 10 is shown oriented in its operative, vertical upright position. Accumulator 10 includes a storage vessel 12 comprising a tubular casing 14, a top end wall 16, and a bottom end wall 18. Tubular casing 14 may be either cylindrical, as shown, or some other suitable shape. Vessel 12 defines an interior storage volume 13 adapted for storing gaseous and liquid refrigerant. Suction accumulator 10 also includes an inlet 20 and an outlet 22. Inlet 20 is in communication with an inlet opening 24 in top end wall 16, while outlet 22 is inserted through an outlet opening 26 in top end wall 16. Preferably, the inlet and outlet each comprise copper tubes which are sealingly secured to top end wall 16 by soldering, brazing, or the like.

A baffle 28 is shown mounted in an upper portion of vessel 12, whereby refrigerant fluid entering inlet 20, as shown by means of arrow 30 indicating the direction of flow, strikes baffle 28 and is deflected. By means of this arrangement, the refrigerant fluid is separated into a liquid component and a gaseous component, whereby the liquid component is caused to flow in a swirling pattern tangentially along the vessel wall so as to collect in the bottom of vessel 12. The gaseous component flows to outlet 22 by way of a flow path through accumulator 10 as further explained hereinbelow. The construction and method of operation of baffle 28, according to one embodiment thereof, are further described in U.S. Pat. No. 4,651,540, assigned to the same assignee as the present application, the disclosure of which is hereby incorporated herein by reference.

Bottom end wall 18 may be provided with a threaded mounting stud 32 to mount the section accumulator in a vertical position in a refrigeration system, as is conventional. Mounting stud 32 is provided with a welding pad 34 for securing the mounting stud to a depressed portion 36 of end wall 18. Alternatively, depression 36 can be eliminated.

Conduit 38 is shown disposed inside vessel 12. The conduit includes a divider plate or weir 40 to form two fluid flow passages 42 and 44 in conduit 38. Thus, a downflow passage 42 and an upflow passage 44 are provided. Conduit 38 may be made of either extruded aluminum or plastic material, or of conventional metal tubing materials. As shown in FIG. 1, the top end of conduit 38 includes a first opening 46 connected to outlet 22 and a second opening 48 in open fluid communication with interior storage volume 13.

Figure 2:
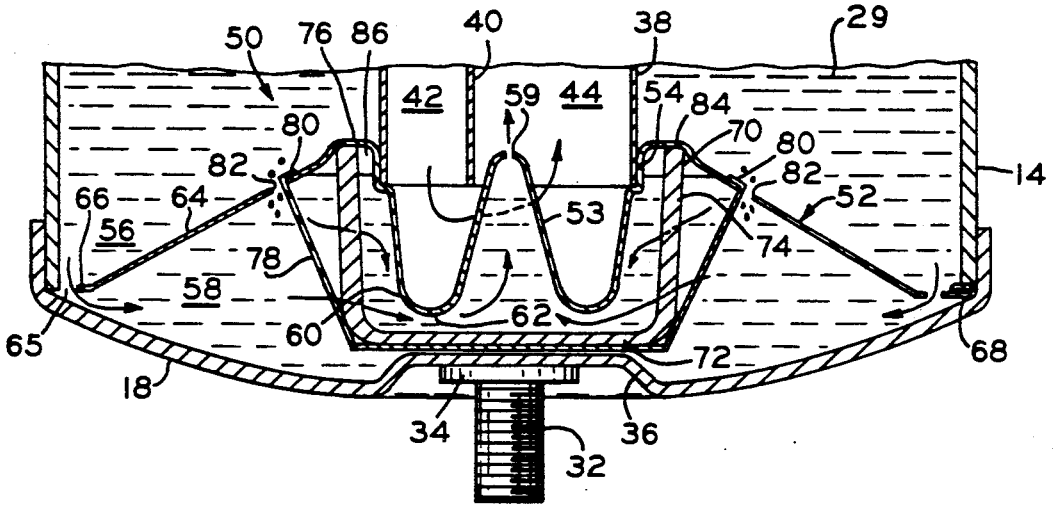
FIG. 2 is an enlarged fragmentary longitudinal sectional view of the lower portion of the suction accumulator of FIG. 1.

Suction accumulator 10, in accordance with a preferred embodiment of the present invention, includes a vessel interior baffle or partition means 50, comprising dirt trap partition member 52. Partition member 52 substantially separates interior storage volume 13 into an upper active zone 56 and a lower quiet zone 58. As shown in FIG. 2, and more fully described hereinafter, partition member 52 is retained at a peripheral edge thereof between tubular casing 14 and bottom end wall 18, and is spaced away from end wall 18. The center portion 54 of partition 52 is sealingly secured to a lower end portion of conduit 38 to provide fluid communication between downflow passage 42 and upflow passage 44 of conduit 38. Additionally, partition 52 includes a conical center portion 53 having a bleed-through orifice 59 therein through which liquid refrigerant from quiet zone 58 is metered into gaseous refrigerant flowing through upflow passage 44. Partition member 52 may be sealed to conduit 38 by an interference fit, welding, an adhesive, or the like, depending on the materials chosen.

Partition member 52 will now be more particularly described. In the preferred embodiment, partition member 52 is manufactured as a stamped sheet metal part and comprises a round plate member having a radially serpentine configuration as shown. More specifically, member 52 includes an annular barrier wall 60 extending downwardly from portion 54 and having an edge 62 under which flows liquid refrigerant. A frustoconical flange portion 64 extends radially outwardly from portion 54.

In accordance with the preferred embodiment of the present invention, fluid communication between active zone 56 and quiet zone 58 is provided through an annular gap 65 defined between a peripheral edge portion 66 of partition member 5 and the interior of vessel 12. More specifically, a plurality of circumferentially spaced spacer tabs 68 are provided on the periphery of baffle member 52, and are retained between tubular casing 14 and bottom end wall 18. In this arrangement, peripheral edge portion 66, constituting the peripheral edge of partition member 52 circumferentially intermediate tabs 68, is spaced from both casing 14 and end wall 18. According to the preferred embodiment, spacer tabs 68 are formed by initially stamping member 52 with radially extending portions and the folding them radially inwardly to form a tab having a greater thickness than the adjacent peripheral edge portion.

A cup-shaped filter 70 comprising a lower wall 72 and a cylindrical, slightly tapered side wall 74 is disposed over the end of conduit 38 within quiet zone 58, and between the radial outer region of quiet zone 58 and the interior of conical center portion 53. Filter 70 is preferably made of sintered powdered metal, preferably iron, having a porosity of 20 microns and a wall thickness of 0.120 inches. Thus, bottom wall 72 and side wall 74 are porous, thereby presenting a large surface area for the filtration of liquid refrigerant. Although sintered powdered metal is preferred, filter 70 could be made of other suitable materials.

Filter 70 is supported against an upper portion 76 of partition member 74 by means of a spring steel strap 78, which can be relatively narrow and which extends underneath bottom wall 72 of filter 70. Strap 78 includes a pair of locking ears 80 that extend through vent openings 82 in partition member 52. Alternatively to a flat strap 78, a spring wire (not shown) could be used. Strap 78 presses the upper annular edge 84 of filter 70 against the upper portion 76 of partition member 52, thereby supporting lower wall 72 away from end cap 18 of the suction accumulator 10. This makes substantially the entire surface area of the filter 70 available for filtration.

Vent openings 82 allow gas bubbles to vent back into storage area 13 to thereby increase the effective usable area of the filter because gas cavitation will not occur. Vents 82 are preferably positioned below the upper edge 76 of partition member 52 so as to form an annular gas pocket 86 which prevents the migration of liquid refrigerant and entrained dirt particles across the upper edge 84 of filter 70. This negates the need for sealing or gasketing the filter 70 to partition member 52.

In operation, refrigerant fluid, including gaseous and entrained liquid refrigerant, flows through inlet 20 and is separated by baffle 28 into its gaseous and liquid components. Because of the influence of baffle 28, the liquid component will flow to the bottom of the storage vessel 12 in a downwardly spiralling path along the inside wall of casing 14. The gaseous component will flow from the upper end of storage vessel 12 through downflow passage 42, a connecting passage defined by portions 53 and 60 of partition member 52, up through passage 44 and out through outlet 22. Metering of liquid refrigerant occurs through orifice 59 in a known manner.

Liquid refrigerant flowing through gap 65 enters quiet zone 58 wherein larger dirt particles can separate out and settle to the bottom. The liquid refrigerant then flows through porous filter 70 and follows a tortuous path in flowing around the edge 62 of the barrier formed by walls 60 and 53. Liquid refrigerant will not flow over the upper edge 84 of filter 70 due to the existence of gas pocket 86. Filter 70 effectively filters out smaller particles having a size greater than the pore size of the filter.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A suction accumulator for a compressor of a refrigeration system, comprising:

a vertical storage vessel defining an interior storage volume, said vessel having a top end and a bottom end and including a vessel inlet and a vessel outlet located at said top end thereof, said vessel being adapted for storing gaseous and liquid refrigerant introduced through said vessel inlet for drawing out through said vessel outlet;

a conduit, disposed within said vessel, having an end opening connected to said vessel outlet, a gas inlet opening means located toward said vessel top end for communication with the gaseous refrigerant, and a liquid metering inlet located in a radially inner region of said interior storage volume toward said vessel bottom end for communication with the liquid refrigerant;

baffle means disposed within said vessel, for directing the liquid refrigerant within said vessel to a radially outer region of said interior storage volume toward said vessel bottom end;

said baffle means comprising radially extending partition means for substantially separating said storage volume into an upper active zone and a lower quiet zone, and fluid passage means for providing fluid communication between said active zone and said quiet zone; and a cup-shaped filter disposed in said quiet zone between a radially outer region of said quiet zone and a radially inner region of said quiet zone to filter liquid refrigerant flowing from said quiet zone to said metering inlet, said filter having a porous bottom wall and a porous side wall.

2. The suction accumulator of claim 1 wherein said filter is cylindrical and has an annular side wall which is porous substantially completely around its periphery.

3. The suction accumulator of claim 1 wherein said baffle means includes a barrier means disposed between said filter and said metering inlet for causing tortuous flow of the liquid refrigerant from the radially outer region of said quiet zone to the radially inner region of the quiet zone.

4. The suction accumulator of claim 3 wherein said barrier means comprises an annular barrier extending into said filter and being spaced away from said filter, said annular barrier including an edge under which liquid refrigerant flow.

5. The suction accumulator of claim 4 wherein said filter is supported against said baffle means at an annular edge of said filter and is spaced away from said baffle means at substantially all other points on said filter.

6. The suction accumulator of claim 3 including: support means for supporting said filter against said baffle means at an upper edge of said filter and means on said baffle means forming a gas pocket in the area of said filter upper edge to thereby inhibit the flow of liquid refrigerant between said filter edge and said baffle means.

7. The suction accumulator of claim 1 including: support means for supporting said filter against said baffle means at an upper edge of said filter and means on said baffle means forming a gas pocket in the area of said filter upper edge to thereby inhibit the flow of liquid refrigerant between said filter edge and said baffle means.

8. The suction accumulator of claim 7 including a vent opening in said baffle means positioned at a level below said gas pocket.

9. The suction accumulator of claim 8 wherein said filter has a cylindrical side wall that is substantially completely porous.

10. The suction accumulator of claim 7 wherein said filter has a cylindrical side wall that is substantially completely porous.

11. The suction accumulator of claim 1 wherein said filter consists essentially of porous sintered powdered metal.

12. The suction accumulator of claim 1 wherein said partition means comprises a partition member having an outer peripheral edge spaced inwardly from said vessel to form a gap through which liquid refrigerant flows from the active zone to the quiet zone.

13. The suction accumulator of claim 12 wherein said partition member outer peripheral edge is spaced inwardly along its outer peripheral edge, and wherein said gap is annular.

14. The suction accumulator of claim 1 including a strap means extending underneath said filter and being connected to said partition means for suspending said filter from said partition means.

15. A suction accumulator for a compressor of a refrigeration system, comprising:

a vertical storage vessel defining an interior storage volume, said vessel having a top end and a bottom end and including a vessel inlet and a vessel outlet located at said top end thereof, said vessel being adapted for storing gaseous and liquid refrigerant introduced through said vessel inlet for drawing out through said vessel outlet;

a conduit, disposed within said vessel, having an end opening connected to said vessel outlet, a gas inlet opening means located toward said vessel top end for communication with the gaseous refrigerant, and a liquid metering inlet located toward said vessel bottom end for communication with the liquid refrigerant;

partition means located near said bottom end for substantially separating said storage volume into a lower quiet zone and an upper active zone, said gas inlet opening means being in fluid communication with said active zone and said liquid inlet opening means being in fluid communication with said quiet zone;

passage means for providing fluid communication between said active zone and said quiet zone at a location radially outwardly from said liquid inlet opening means and adjacent the side wall of said storage vessel; and a porous, cup-shaped filter disposed in said quiet zone over a lower end of said conduit for filtering liquid flowing from said quiet zone to said metering inlet, and means for sealing said filter to said conduit comprising a gas pocket underneath said partition means, an upper edge of said filter being disposed in said gas pocket.

16. The suction accumulator of claim 15 wherein said means for sealing comprises a portion of said partition means.

17. The suction accumulator of claim 15 wherein said lower quite zone comprises a radially outer region and a radially inner region, and further comprising: an annular wall, disposed between said radially outer region and said radially inner region, under which the liquid refrigerant flows in a tortuous flow path from said radially outer region to said radially inner region.

18. The suction accumulator of claim 15 in which:

said storage vessel comprises a generally cylindrical central portion and a lower end cap; and said partition means comprises a partition plate member having a plurality of circumferentially spaced spacer tabs along the outer periphery thereof, said tabs being retained intermediate said central portion and said end cap, a peripheral edge of said plate member intermediate said tabs being spaced from said storage vessel to define a substantially annular gap, whereby said quiet zone is in fluid communication with said active zone through said substantially annular gap.

19. The suction accumulator of claim 18 in which said peripheral edge of said plate member is spaced from said storage vessel such that said resulting gap is capable of trapping the largest of the foreign particles.

* * * * *